United States Patent [19]

Medlin

[11] 4,358,670

[45] Nov. 9, 1982

[54] PULSE ADDER—SUBTRACTER DIFFERENCE TRANSMITTER

[76] Inventor: John W. Medlin, 6413 Edgemoor, Houston, Tex. 77074

[21] Appl. No.: 137,318

[22] Filed: Apr. 4, 1980

[51] Int. Cl.[3] ..... G06M 3/14

[52] U.S. Cl. ..... 235/92 CT; 235/92 MP; 235/92 EV; 137/554

[58] Field of Search ..... 235/92 EV, 92 CT, 92 MP, 235/92 V; 137/554; 364/139, 167

[56] References Cited

U.S. PATENT DOCUMENTS

| | | | |
|---|---|---|---|
| 3,751,644 | 8/1973 | Mayer | 235/92 EV |
| 3,794,814 | 2/1974 | Lay et al. | 235/92 EV |
| 3,968,401 | 7/1976 | Bryant | 235/92 EV |
| 4,000,400 | 12/1976 | Elder | 235/92 EV |
| 4,005,409 | 1/1977 | Feuer | 235/92 CT |
| 4,107,595 | 8/1978 | Campe | 235/92 MP |

*Primary Examiner*—Joseph M. Thesz
*Attorney, Agent, or Firm*—Jack W. Hayden

[57] ABSTRACT

A pulse adder—subtracter difference transmitter to which electrical power is supplied includes first normally open switch means which temporarily closes in response to an event to transmit an electrical pulse, second normally open switch means which temporarily closes in response to an event to transmit an electrical pulse, movement means responsive to the pulse from the first switch means to move in one direction and responsive to the pulse from said second switch means to move in an opposite direction whereby the resulting movement of said means is proportional to the difference between the pulses from said first and second switch means and response means responsive to the resulting movement of the movement means to provide a signal which is proportional to the resulting movement.

1 Claim, 4 Drawing Figures

PULSE ADDER—SUBTRACTER DIFFERENCE TRANSMITTER

SUMMARY OF THE INVENTION

Various types of add and subtract steppers and stepper motors are available and are in use at the present time. However, heretofore, and so far as known to applicant, there has not been available on the market a pulse adder-subtracter difference transmitter which operates off of ordinary 110–120 volt power source.

An object of the present invention is to provide a pulse adder-subtracter difference transmitter which is powered by 110–120 volt source and which includes switch means to provide adding and subtracting pulses the result of which is the difference between an added number and a subtracted number that acts upon response means to provide a signal which is proportional to the difference between the added number and the subtracted number.

The present invention may be employed in any situation where a number is used as the control. For example, the present invention may be used to add and subtract the total number of people entering a building or an enclosure and to transmit the difference in this number to a source which controls the amount of outside air admitted to the building or enclosure per unit of time.

Similarly, it may be used in any other situation where it is desired to use the difference between a total added quantity and a total subtracted quantity as the control means.

Other objects and advantages of the present invention will become readily apparent from a consideration of the following description and drawings.

DESCRIPTION OF THE PREFERRED EMBODIMENTS

Figure 4:
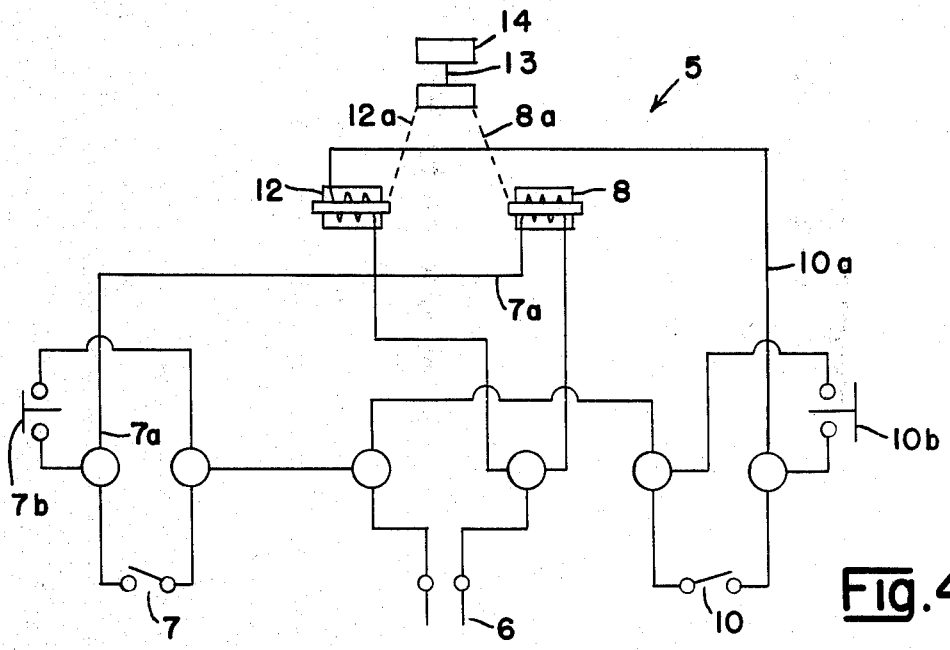
FIG. 4 is a diagrammatic wiring diagram of one form of apparatus which may be employed to provide a total added number and a total subtracted number which in turn provides a signal that is proportional to the difference between the total added number and the total subtracted number.

Attention is first directed to FIG. 4 of the drawings wherein a schematic wiring diagram of a form of the present invention is shown and which includes a solenoid actuated add and subtract stepper as illustrated. The solenoid actuated add and subtract stepper device is that as found on the market and is available from Guardian Electric Manufacturing Co. of Chicago, Illinois, being type PAS-120AC.

In FIG. 4 the form of the present invention is illustrated as being connected to a common electrical power source as represented at 6. A limit switch is illustrated at 7 which is normally open but which is temporarily closed by the occurrence of any event to provide an electrical pulse to the add solenoid represented at 8. For example, the limit switch 7 may be a photoelectric cell at the door of a building or enclosure and when anyone passes into the enclosure and trips the photoelectric cell, this momentarily closes the normally open switch 7 to provide a pulse through the electrical conduit 7*a* to the add solenoid 8.

A second normally open switch means is represented at 10, which again may be of any suitable form such as a photoelectric cell at the exit of a building or enclosure and when such photoelectric cell is actuated by anyone exiting from the building, this momentarily closes the normally open second switch means 10 and provides an electrical pulse through the electrical conduit 10*a* to the subtract solenoid 12.

The add solenoid 8 and subtract solenoid 12 are mechanically linked as diagrammatically represented at 8*a* and 12*a* to move, or rotate, movement means such as a lead screw represented at 13.

For example, the add solenoid 8 will cause the lead screw 13 with which it is mechanically connected as diagrammatically represented at 8*a* to rotate and move longitudinally in one direction, while the subtract solenoid 12 causes the lead screw 13 with which it is mechanically connected as diagrammatically represented at 12*a* to rotate and move longitudinally in the opposite direction. The mechanical connection between the add and subtract solenoids is of any type well known to those skilled in the art. Thus, the rotational and hence resulting longitudinal movement of the lead screw 13 is the difference in the sum of the pulses provided to the add solenoid 8 from switch means 7 and the subtract pulses provided to the subtract solenoid 12 from switch means 10. The lead screw is diagrammatically represented at 13 and it in turn acts upon suitable response means diagrammatically represented at 14 to provide a signal that is proportional to the longitudinal movement of the lead screw 13 which results from the difference between the total added and total subtracted pulses provided by solenoids 8 and 12 respectively. The numeral 14 may represent any one of several devices.

Figure 1:
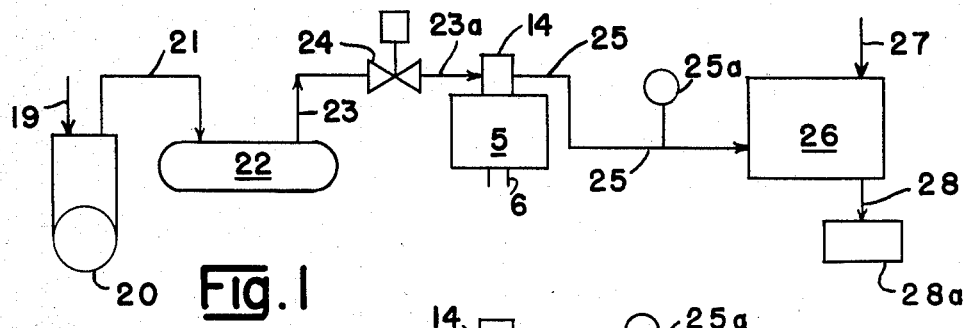
FIG. 1 is a schematic diagram illustrating one form of the transmitter of the present invention with which is connected a compressed air source, the form of the transmitter of the present invention shown in FIG. 1 determining the pneumatic pressure transmitted to a pneumatic controller as an indication of the difference between a total added quantity and a total subtracted quantity.

For example, where the present invention is to be employed with pneumatic pressure controllers, an arrangement as illustrated in FIG. 1 may be employed. A compressor 20 receives air from inlet 19 and discharges it through discharge conduit 21 to the tank 22. The conduit 23 connects with the pressure regulator 24 to maintain the pressure in the conduit 23*a* within a predetermined range.

The pulse adder-subtracter difference transmitter of the present invention is diagrammatically illustrated at 5. Since the transmitter of the present invention is shown in part of FIG. 1 and FIG. 2 as functioning with a pneumatic arrangement, the device illustrated at 14 in FIG. 2 will be a pneumatic pressure regulator, and the longitudinal movement of the lead screw 13 controls the position of a part of the pressure regulator 14 to in turn control the pressure in the exit pneumatic conduit 25. The amount of pressure in the conduit 25 in turn effects control of the pneumatic controller represented at 26 with which compressed air is communicated at 27. The compressed air discharged through conduit 28 in response to the pressure existing in conduit 25 from the pressure regulator 14 effects control of a device as schematically represented at 28*a*.

Figure 2:
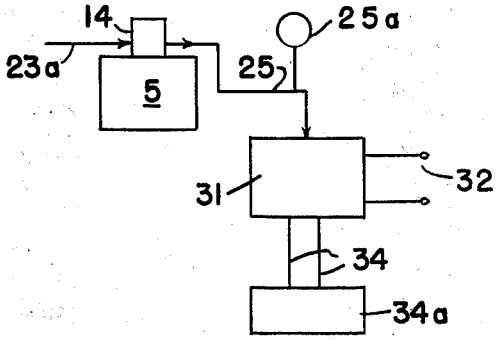
FIG. 2 diagrammatically represents the form of transmitter shown in FIG. 1 of the present invention, with which is connected the compressed air source illustrated in FIG. 1, the output of the transmitter being connected to a transducer, the output of which transducer represents the difference between a total added quantity and a total substracted quantity as provided by the transmitter.

FIG. 2 diagramatically represents the arrangement where it is desired to use a pneumatic signal from transmitter 5 to provide an electrical signal. The transmitter 5 is again connected with an air source through the pressure regulator 24. The exit pressure in conduit 25 of FIG. 2 is again controlled by transmitter 5 and represents the difference between the total added and total subtracted pulses as previously described. A transducer represented at 31 receives the pressure signal from line 25 and is provided electrical power from a power source as represented at 32. The amount of pneumatic pressure in line 25 supplied to the transducer 31 will in turn control a variable electric signal, such as a variable amperage or a variable voltage on the output conduits 34 of transducer 31. The variable voltage or amperage in output conduits 34 control any suitable device represented at 34*a*.

It can be appreciated that in some circumstances it may be desired to employ some other device 14 other than a pneumatic pressure regulator as a response means which is responsive to the resulting longitudinal movement of the lead screw 13 to provide a signal which is proportional to the resulting movement of the lead screw 13 in response to the difference in the total number of pulses from the add solenoid 8 and the total number of pulses supplied to the subtract solenoid 12.

For example, a linear potentiometer may be substituted for the pressure regulator 14 which will provide a direct milliampere signal in response to longitudinal movement of the lead screw 13 where it is desired to use the transmitter of the present invention with standard electrical controllers. One suitable linear position transducer or linear potentiometer which would function satisfactorily is model 5175 of Bourns, Inc. of Riverside, California.

A suitable displacement transducer which may be used as a linear displacement transducer in lieu of the pressure regulator 14 to provide a direct voltage signal in response to movement of lead screw 13 for use with standard electrical controllers and operators is that such as series 240 in instruction bulletin 240-BGD of Trans.-Teck Inc.

Instead of linear potentiometer means to provide a milliamp signal or linear displacement transducer means to provide a voltage signal, rotary type means may be employed to provide a milliamp signal or a voltage signal, respectively, instead of a pneumatic signal. Such rotary type devices are well known in the art and thus no detail description is deemed necessary.

Figure 3:
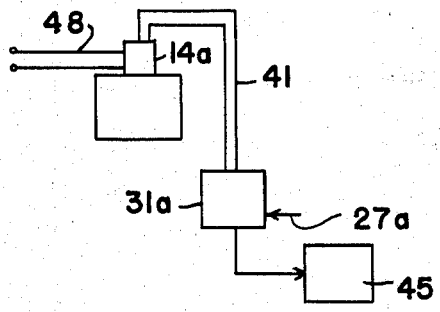
FIG. 3 represents a modified form of transmitter to provide an electrical signal which is representative of the difference between a total added quantity and a total subtracted quantity as measured by the transmitter, the output of the transmitter being connected to a transducer.

FIG. 3 is a diagrammatic representation where an electrical component such as one of the foregoing of the present invention is used in lieu of a pneumatic pressure regulator 14.

Electrical conduit means 48 supplies power to the linear or rotary potentiometer, or rotary or linear displacement transducer represented at 14*a* on transmitter 5.

The resulting electrical signal in line 41 represents the longitudinal movement of lead screw 13 which in turn represents the difference between the total add pulses and total subtract pulses measured by transmitter 5. The signal in conduit 41 is supplied to transducer 31*a* with which compressed air is communicated at 27*a*. This signal is converted to a pneumatic signal by transducer 31*a* and is supplied from transducer 31*a* to pneumatic controller 45 as represented by the conduit from 31*a* to controller 45.

Also, in lieu of the add-subtract solenoid arrangement as disclosed in FIG. 4 and identified hereinabove, a stepper motor may be employed with the present invention. One suitable stepper motor which may be used is that identified as part No. 3205-001 of Hurst Mfg. Corp., Princeton, Indiana. If desired a stepper motor incorporating a lead screw could be employed such as that represented by part No. 3602-001 of Hurst Mfg. Corp., Princeton, Indiana. In such event, this stepper motor would take the place of the solenoids 8 and 12 represented in FIG. 1 as well as the mechanical connections 8*a*, 12*a* and the lead screw 13, since the above identified stepper motor would incorporate these elements.

The switch means 7*b* may be employed for subtracting pulses and the switch means 10*b* may be employed for adding pulses until the signal representing zero is reached.

By way of further example the pneumatic pressure in line 23*a* may be in the range of 20 to 30 psi. When the pressure in conduit 25 is 3 psi, the gauge 25*a* will read 3 psi and this represents the number zero. At this reading, the lead screw will have moved thru approximately 20% of its stroke or movement. The pressure in conduit 25 will be 15 psi when the lead screw 13 has had 100% movement in response to the difference in the sum of pulses to add solenoid 8 and subtract solenoid 12.

One suitable form of pressure regulator 14 which may be employed is Fairchild Model 70BR, Catalog No. 70220 made by Fairchild Industries, Industrial Products Division, Winston Salem, North Carolina.

When using the following components (Guardian Electric Manufacturing Co. stepper device Type PAS-120AC; 32 threads per inch on lead screw 13; and Fairchild Pressure Regulator Model 70 BR Catalog No. 70220), the unit as shown in the drawings has a basic theoretical number of 348 at an output pressure of 15 psi when using 3 psi as zero with a tolerance of about 10% ±. This is intended to be used as a set point indicator with any pneumatic controller or transducer operating on the standard 3 to 15 psi pneumatic instrument system and can be used as a controller for operators which do not require much air for operation. With the addition of a volume booster relay it is possible to control pneumatic operators which require larger amounts of air. With the addition of pressure multiplying pneumatic relays, the invention can be used with other pressure ranges or can be used for smaller numbers with 3 to 15 psi range. Models for larger numbers can be made by interposing a speed reducer such as Winfred M. Berg, Inc., Servo Gear Box between the mechanical connection 8*a*, 12*a* of the add solenoid 8, subtract solenoid 12 and the lead screw 13. This will handle a theoretical number up to 217500.

Instead of pressure regulator 14, a linear or rotary motion transmitter may be employed such as that manufactured by Moore Products Co., Spring House, Pa., Model 75SN Double-Acting Valve Positioner connected as a motion transmitter. This increases the accuracy of the signal.

Whether the stepper motor or the add-subtract solenoid arrangement is employed, or whether the response means 14 is pneumatic or electric as disclosed herein it can be appreciated that the present invention provides an arrangement so that the response means 14 is responsive to the total resulting movement of the member 13 so as to provide a signal that is proportional to the total resulting movement of the lead screw 13. This signal is proportional to the difference between the total added pulses to either the stepping motor or add solenoid 8 and the total subtract pulses supplied to the stepping motor or the subtract solenoid 12 that causes means such as lead screw 13 to move.

The foregoing disclosure and description of the invention are illustrative and explanatory thereof, and various changes in the size, shape, components and materials as well as in the details of the illustrated constructon may be made without departing from the spirit of the invention.

What is claimed is:

1. A pulse adder-subtracter difference transmitter to which electrical power is supplied comprising:

a. first normally open switch means which temporarily closes in response to an event to transmit an electrical pulse;

b. second normally open switch means which closes temporarily in response to an event to transmit an electrical pulse;

c. movement means, said movement means including:
a lead screw;
an add solenoid;
a subtract solenoid;
means mechanically linking each said add and said substract solenoid to said lead screw with said add solenoid being responsive to the pulse from said first switch means to move said lead screw in one direction and said subtract solenoid being responsive to the pulse from said second switch means to move said lead screw in the opposite direction whereby the resulting movement of said lead screw is proportional to the sum of the difference between the pulses from said first and second switch means;

d. response means which consists of a pneumatic pressure regulator connected to a pneumatic pressure source, said pneumatic pressure regulator being responsive to the position of said lead screw to provide a pneumatic pressure output signal from said pressure regulator which is proportional to the position of said lead screw.

* * * * *